US007909338B2

(12) United States Patent
Koehler et al.

(10) Patent No.: US 7,909,338 B2
(45) Date of Patent: Mar. 22, 2011

(54) ADAPTER MEMBER OF A ROCK ANCHOR

(75) Inventors: Oliver Koehler, Munich (DE); Wolfgang Ludwig, Klosterlechfeld (DE); Kay Heemann, Kaufering (DE)

(73) Assignee: Hilit Aktiengesellschaft, Schaan (LI)

( * ) Notice: Subject to any disclaimer, the term of this patent is extended or adjusted under 35 U.S.C. 154(b) by 1087 days.

(21) Appl. No.: 11/700,440

(22) Filed: Jan. 30, 2007

(65) Prior Publication Data

US 2007/0177949 A1 Aug. 2, 2007

(30) Foreign Application Priority Data

Jan. 31, 2006 (DE) ..... 10 2006 000 042

(51) Int. Cl.
*B23B 31/02* (2006.01)
*E21D 20/00* (2006.01)

(52) U.S. Cl. ..... 279/145; 279/157; 405/259.1; 405/259.5

(58) Field of Classification Search ..... 279/143, 279/145, 157; 405/259.1, 259.5; *B23B 31/02; E21D 20/00*

See application file for complete search history.

(56) References Cited

U.S. PATENT DOCUMENTS

| | | | | |
|---|---|---|---|---|
| 4,655,643 | A * | 4/1987 | Lane et al. | 405/259.5 |
| 5,263,804 | A * | 11/1993 | Ernst et al. | 411/82 |
| 5,282,697 | A * | 2/1994 | Maechtle | 405/259.6 |
| 6,457,910 | B1 * | 10/2002 | Ludwig et al. | 405/259.1 |
| 6,491,478 | B2 * | 12/2002 | Sager et al. | 405/259.6 |
| 6,802,674 | B2 * | 10/2004 | Peltonen et al. | 405/259.5 |
| 6,955,504 | B2 * | 10/2005 | Leibhard et al. | 405/259.5 |
| 7,025,538 | B2 * | 4/2006 | Ludwig et al. | 405/259.5 |
| 7,033,117 | B2 * | 4/2006 | Ludwig et al. | 405/259.5 |
| 7,377,724 | B2 * | 5/2008 | Oberg et al. | 405/259.3 |
| 7,381,013 | B1 * | 6/2008 | Rataj et al. | 405/259.5 |
| 7,520,341 | B1 * | 4/2009 | DeVall | 175/57 |
| 7,591,328 | B2 * | 9/2009 | Guede | 175/118 |
| 2007/0264088 | A1 * | 11/2007 | Richter | 405/259.5 |
| 2009/0304455 | A1 * | 12/2009 | Bayerl et al. | 405/259.6 |
| 2010/0230909 | A1 * | 9/2010 | Bayerl et al. | 279/145 |

* cited by examiner

*Primary Examiner* — Eric A Gates

(74) *Attorney, Agent, or Firm* — Abelman, Frayne & Schwab

(57) ABSTRACT

An adapter member for connecting a self-drilling rock anchor (1; 31; 69) with a chuck (6) of a drilling tool, includes a sleeve-shaped section (17; 37) having a bottom (20; 40; 60; 80) provided at an end (19; 39) of the sleeve-shaped section (17; 37) for forming a receiving space (21) for connection with an end (4; 34) of the rock anchor (1; 31; 69), and a seal (23; 43; 63; 83) arranged in a region of the bottom (20; 40; 60; 80) and extending from the receiving space (21) to at least a plane (E1; E2; E3; E4) defined by the bottom.

7 Claims, 5 Drawing Sheets

ADAPTER MEMBER OF A ROCK ANCHOR

BACKGROUND OF THE INVENTION

1. Field of the Invention

The present invention relates to an adapter member for connecting a self-drilling rock anchor with a chuck of a drilling tool and including a sleeve-shaped section having a coupling section for connection with the chuck, and a bottom provided at an end of the sleeve-shaped section for forming a receiving space for connection with an end of the rock anchor and having a through-opening through which a feeding nose is extendable.

2. Description of the Prior Art

Self-drilling rock anchors, in particular chemical connection anchors and suitable drilling tools with rotatable chucks, and their use in mine and tunnel constructions are well known since long ago. The rock anchors serve primarily for stabilizing walls and hollow spaces in mines, tunnels, galleries, and the like. When hollow spaces are formed, mechanical properties and, in particular, the bearing capacity of strata are reduced. These strata are anchored to lying further, undamaged strata with rock anchors, e.g., chemical connection anchors, and are, thus, secured thereto.

The self-drilling rock anchor includes an anchor tube that functions, on one hand, as a drill rod and, on the other hand, when formed as a chemical connection anchor, as a receptacle for a to-be-pressed out mass. A drill head is provided at a first, facing in the setting direction, end of the anchor tube. The second end of the anchor tube is inserted into a chuck of a drilling tool with which the rock anchor is set into a constructional component. After completion of a drilling process, with the rock anchor being formed as a chemical connection anchor, the second end of the anchor tube is connected to a suitable squeezing-out device, and the to-be-pressed out mass is displaced in the direction of the drilling head.

With an injection anchor such as described in German Patent DE 101 48 683 C 1, after the completion of a drilling process, a feeding device for an injection mortar is arranged on the second end of the anchor tube, and the injection mortar is injected into the borehole bottom through the anchor tube.

German Publication DE 101 36 040 A1 discloses a self-drilling rock anchor that includes an adapter member connectable with the second end of the anchor tube. The adapter member includes a sleeve-shaped section having a located outside coupling section for connection with the chuck of a drilling tool, and a bottom provided at an end of the sleeve-shaped section for forming a receiving space for connection with a second end of the rock anchor. The bottom has a through-opening for a feeding nose that forms part of a feeding device and through which medium is fed in the self-drilling rock anchor.

German Patent DE 197 00 701 C2 discloses a drilling tool with a chuck and a feeding nose for feeding rinsing means into the self-drilling rock anchor. In order to prevent leakage of the fed rinsing means in the region of the chuck or in the region of medium feeding and in order to prevent any damage of the drilling tool, there are provided, in the drilling tool, several seals. The drawback of this solution consists in that the seals in particular, which come in a contact with the self-drilling anchor, are subjected to a very high wear. As a result of a displacement force of a movable support of the drilling tool that acts on the drilling tool during the drilling process, the surface pressure applied to separate seals is very high, and the seals should be replaced already after several setting processes. The replacement of a worn seal can be a very tedious process, in particular, at an existing conditions (e.g., space relationships).

Accordingly, an object of the present invention is to provide a self-drilling rock anchor that, on one hand, would insure a satisfactory sealing for the media, which are fed to the rock anchor, and, on the other hand, would be user-friendly.

SUMMARY OF THE INVENTION

These and other objects of the present invention, which will become apparent hereinafter, are achieved by providing an adapter member for connecting a self-drilling rock anchor with a chuck of a drilling tool and including a sleeve-shaped section having a coupling section for connection with the chuck and a bottom provided at an end of the sleeve-shaped section for forming a receiving space for connection with an end of the rock anchor. The bottom has a through-opening for a feeding nose. In the bottom region, there is provided a seal that extends from the receiving space at least to a plane defined by the bottom.

The adapter member is arranged on an end of the self-drilling anchor. After the rock anchor has been connected with the drilling tool or with the feeding device, the seal abuts a bearing surface provided in the drilling tool or in the feeding device, so that the displacement force of the movable support compresses the seal, which insures an adequate sealing in the region between the drilling tool or the feeding device and the rock anchor during feeding, e.g., of the rinsing water, injection mortar, or squeezing-out medium. If the adapter member remains on the rock anchor after it has been set, a new seal is available for each drilling process. With a multiple use of the adapter member, it can be used until the seal is worn out. For further setting processes, the adapter member, together with the worn-out seal, is replaced with an adapter member with a new seal, without any additional operations by the user. Alternatively, only the worn-out seal can be replaced with a new seal, with the use of the already mounted adapter. Expensive servicing of the drilling tool or the feeding device, which is associated with replacement of a worn-out seal, is eliminated. Thereby, the service life of a corresponding tool is noticeably increased. In addition, handling of the tool by the user becomes noticeably more friendly.

The seal can be formed, e.g. of an elastomer or resin. Advantageously, the seal is formed of a thermoplastic elastomer.

Advantageously, a rim, which limits the through-opening is provided with retaining means for retaining the seal, whereby the seal is form-lockingly and/or forcelockingly retained in its position until the seal comes into contact with a bearing surface in the drilling tool or in the feeding device.

Advantageously, the retaining means is formed on the rim and is formed integrally with the adapter member. Preferably, the retaining means is formed as a projection that cooperates with a corresponding recess, e.g., a groove formed in the seal, retaining the seal in a position. Preferably, the retaining means circumferentially extends over the rim, which insures a satisfactory fixing of the seal on the adapter member.

Advantageously, the seal at least partially surrounds the through-opening limiting rim. The rim-surrounding section is advantageously so arranged that, upon arrangement of the adapter member on the rock anchor, this section is preloaded between the adaptor and the rock anchor, reliably securing the seal.

According to a further advantageous embodiment of the adapter member, a recess is formed on the bottom for at least regionwise receiving of the seal. The recess or recesses is/are formed, e.g., in the bottom in the rim region of the through-opening. According to one variant, the recess is formed on the outer side of the bottom. The seal, which is arranged in the recess, e.g., O-ring or an annular member, is formed with a polygonal cross-section. The seal is fixed in the recess by being clamped therein or with glue.

Preferably, the recess extends over the entire circumference of the bottom, which insures an adequate fixation of the seal on the adapter member.

The novel features of the present invention, which are considered as characteristic for the invention, are set forth in the appended claims. The invention itself, however, both as to its construction and its mode of operation, together with additional advantages and objects thereof, will be best understood from the following detailed description of the preferred embodiments, when read with reference to the accompanying drawings.

DETAILED DESCRIPTION OF THE PREFERRED EMBODIMENTS

Figure 1:
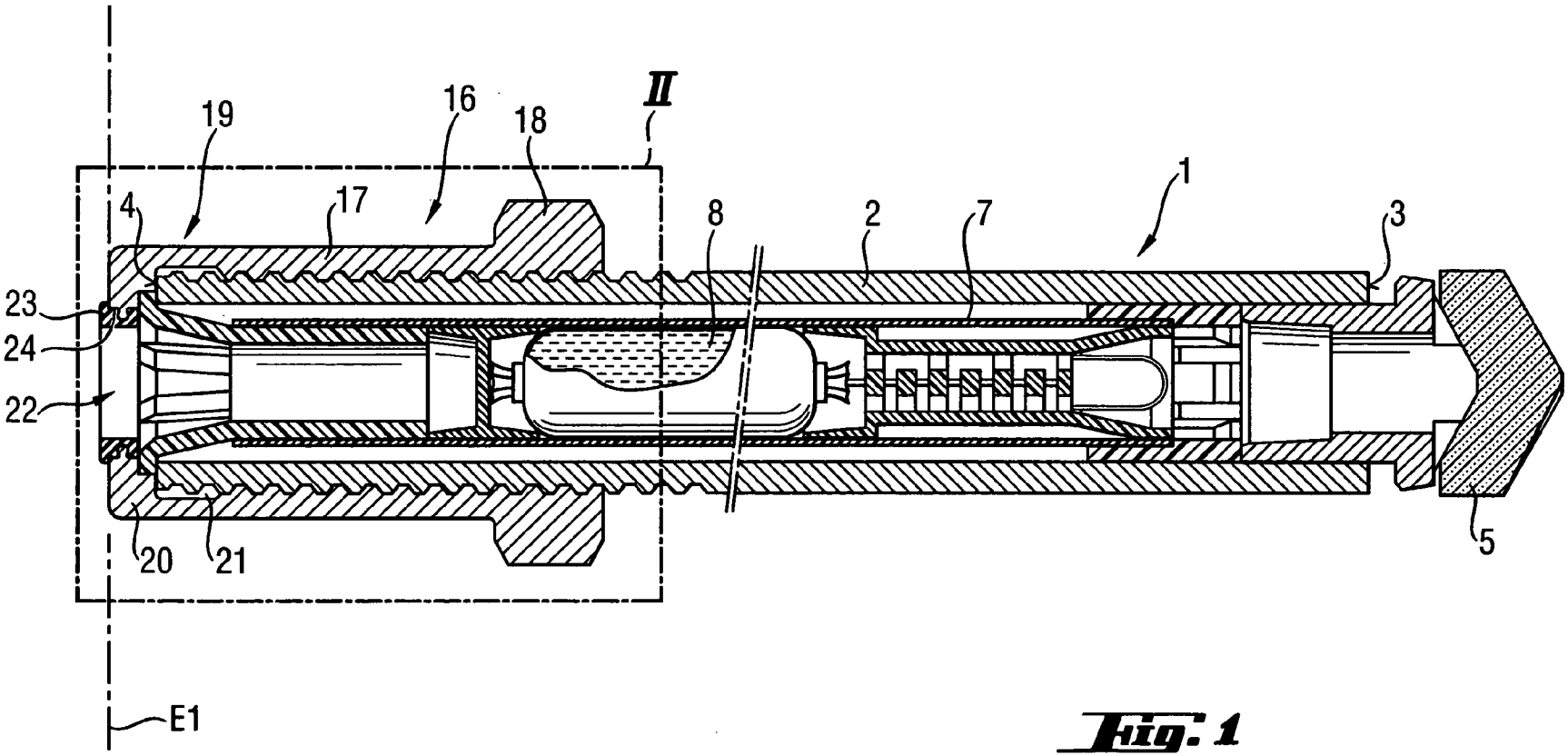
FIG. 1 a longitudinal cross-sectional view of a self-drilling rock anchor with an adapter member according to the present invention.
Figure 2:
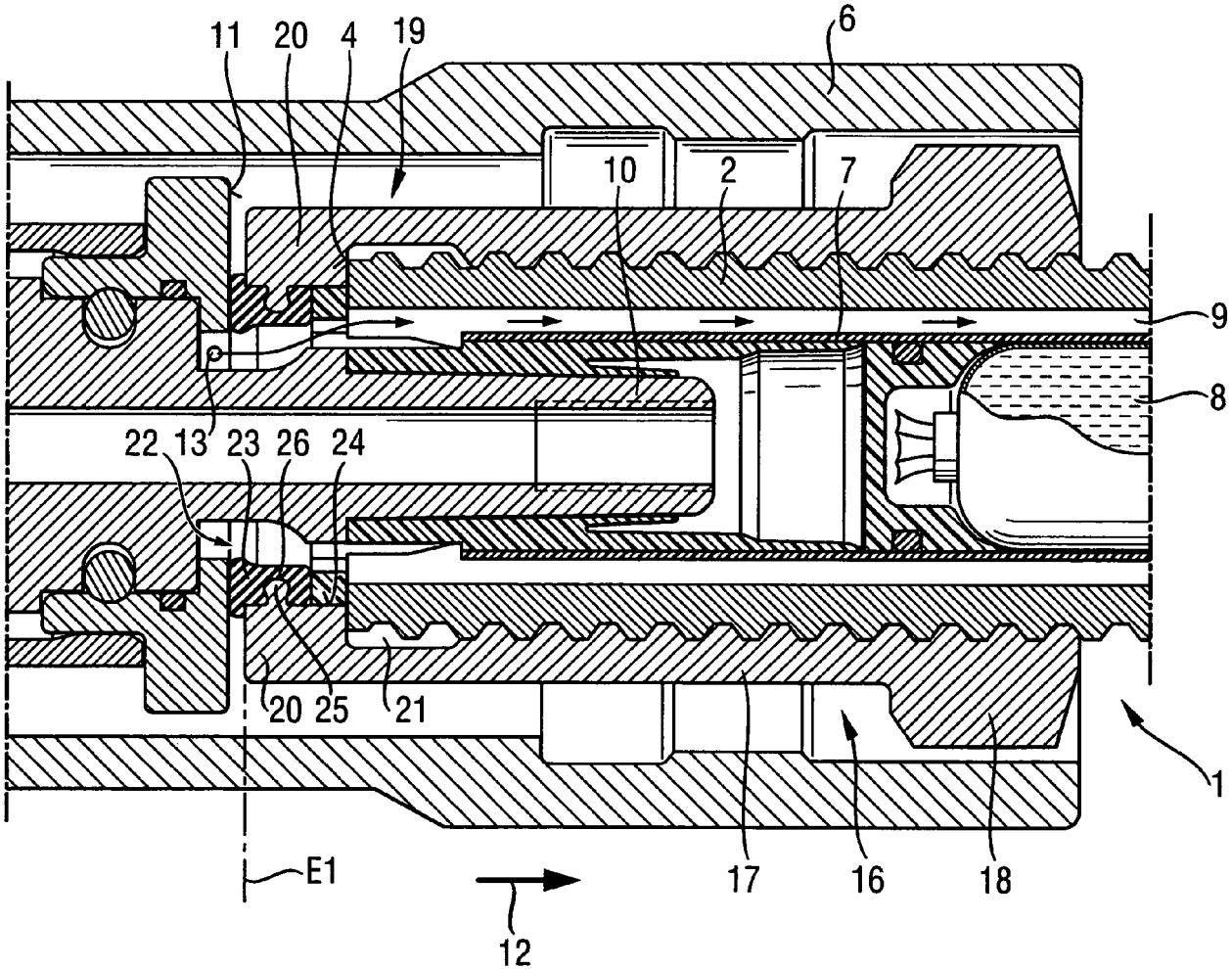
FIG. 2 a detailed cross-sectional view of a first embodiment of the adapter member according to the present invention according to section II in FIG. 1 in a condition in which the adapter member is received in a chuck of a drilling tool.

A self-drilling rock anchor 1, which is shown in FIGS. 1-2, is formed as a chemical connection anchor and includes an anchor tube 2 having a first end 3 at which a drilling head 5 is secured, and a second end 4. In the anchor tube 2, there is arranged an inner tube 7 for receiving a to-be-pressed out chemical mass 8. Between the outer wall of the inner tube 7 and the inner wall of the anchor tube 2, a rinsing water channel 9 is formed. During a drilling process, rinsing water is fed in the region of the drilling head 5 through the rinsing water channel 9 from the drilling tool or a feeding device. For connecting the self-drilling rock anchor 1 with a chuck 6 of the drilling tool, there is provided, on the second end 4 of the anchor tube 2, an adapter member 16 according to the present invention. In the embodiment shown in FIGS. 1-2, the adaptor member 16 is screwed on the anchor tube 2.

The adapter member 16 has a sleeve-shaped section 17 with a coupling section 18 formed as a quick-engagement means and connectable with the chuck of the drilling tool. The sleeve-shaped section 17 has at its end remote from the coupling section 18, a bottom 20. The receiving space 21, which is formed by the sleeve-shaped section 17 and the bottom 20 serves for connecting the adaptor member 16 with the second end 4 of the anchor tube 2 of the self-drilling rock anchor 1. The bottom 20 has a through-opening 22 through which a feeding nose 10 of a feeding device is extendable. The drilling tool can be formed, e.g., as a combination drilling and squeezing-out tool, so that drilling with the self-drilling rock anchor 1 and a subsequent squeezing-out of the to-be-pressed out chemical mass 8 from the rock anchor 1 can be effected without changing the tool.

In the region of the bottom 20, there is provided a seal 23 that extends from the receiving space 21 and beyond the plane E1 defined by an end surface of the bottom 20. On the rim 24, which limits the through-opening 22, there is formed retaining means 25 in form of a circumferential projection for retaining the seal 23 which has a recess 26 in form of a circumferential groove. The retaining means 25 formlockingly retains the seal 23, which is formed of a thermoplastic elastomer, on the adapter member 16.

When the rock anchor 1 is connected to the drilling and squeezing-out tool, as shown in FIG. 2, the seal 23 abuts a bearing surface 11 of the chuck 6 of the tool. As a result of action of a displacement force, which is generated by the tool moving support (not shown in the drawings), on the rock anchor 1 in direction of arrow 12, the rinsing water guide 13 of the drilling and squeezing-out tool, becomes sealed relative to the chuck 6. After completion of the drilling process, the rinsing water is shut off, and the squeezing-out medium is fed into the inner tube 7 through the feeding nose 10 for squeezing out the to-be-pressed out mass 8. Finally, the drilling and squeezing-out tool is disconnected from the rock anchor 1, with the adapter member 16, together with the seal 23, remaining on the set rock anchor 1.

Figure 3:
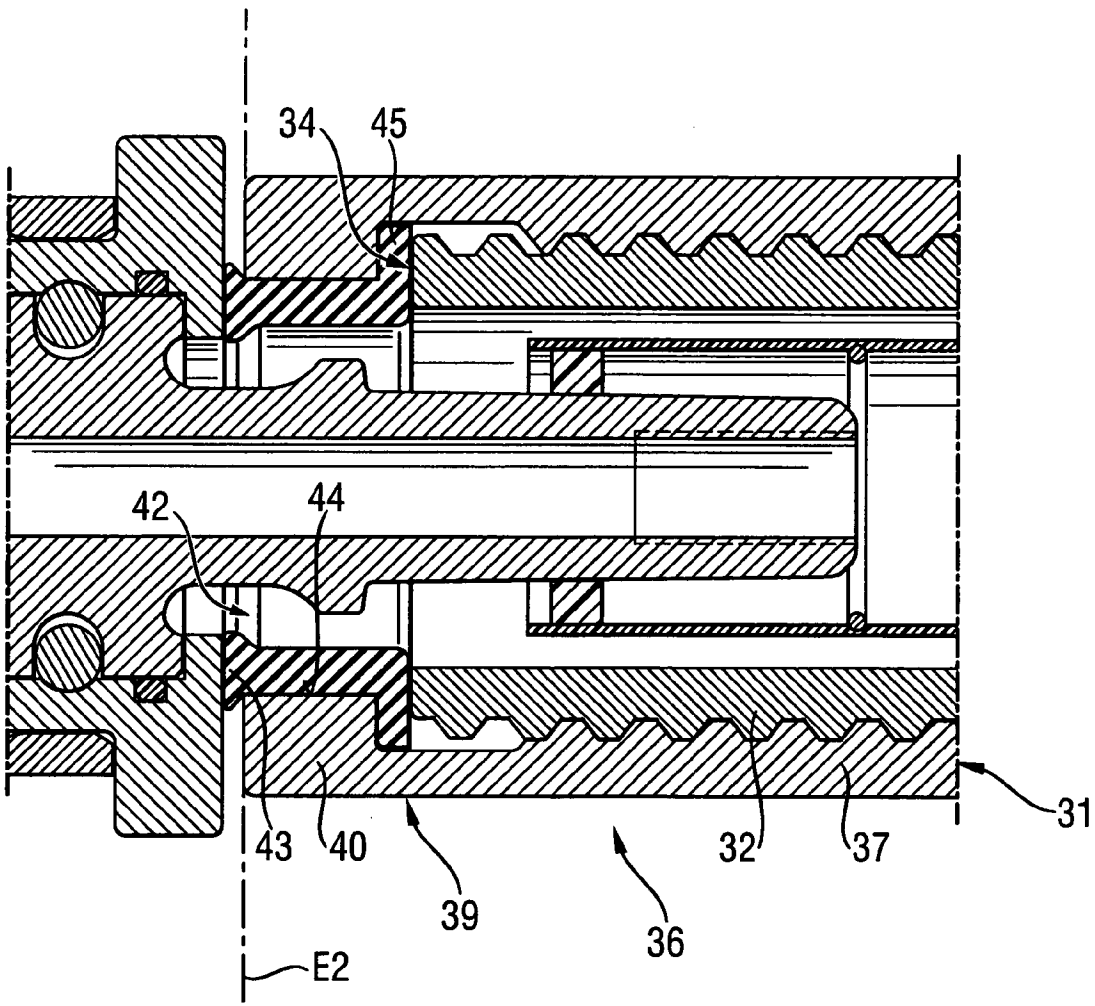
FIG. 3 a detailed cross-sectional view of a second embodiment of the adapter member according to the present invention.

FIG. 3 shows a second embodiment of an adapter member 36 according to the present invention and which likewise has a sleeve-shaped section 37 with a bottom 40 provided at an end 39 of the sleeve-shaped section 37 and having a through-opening 42. A seal 43 engages around the rim 44, that limits the through-opening 42, in the inner region of the adapter member 36 and extends past plane E2 defined by an end surface by the bottom 20. The surrounding portion 45 of the seal 43 is wedged, in the connected condition of the adapter member 36, at the second end 434 of the anchor tube 42 of the rock anchor 31, between the bottom 40 and the end surface of the anchor tube 42 at the end 34.

Figure 4:
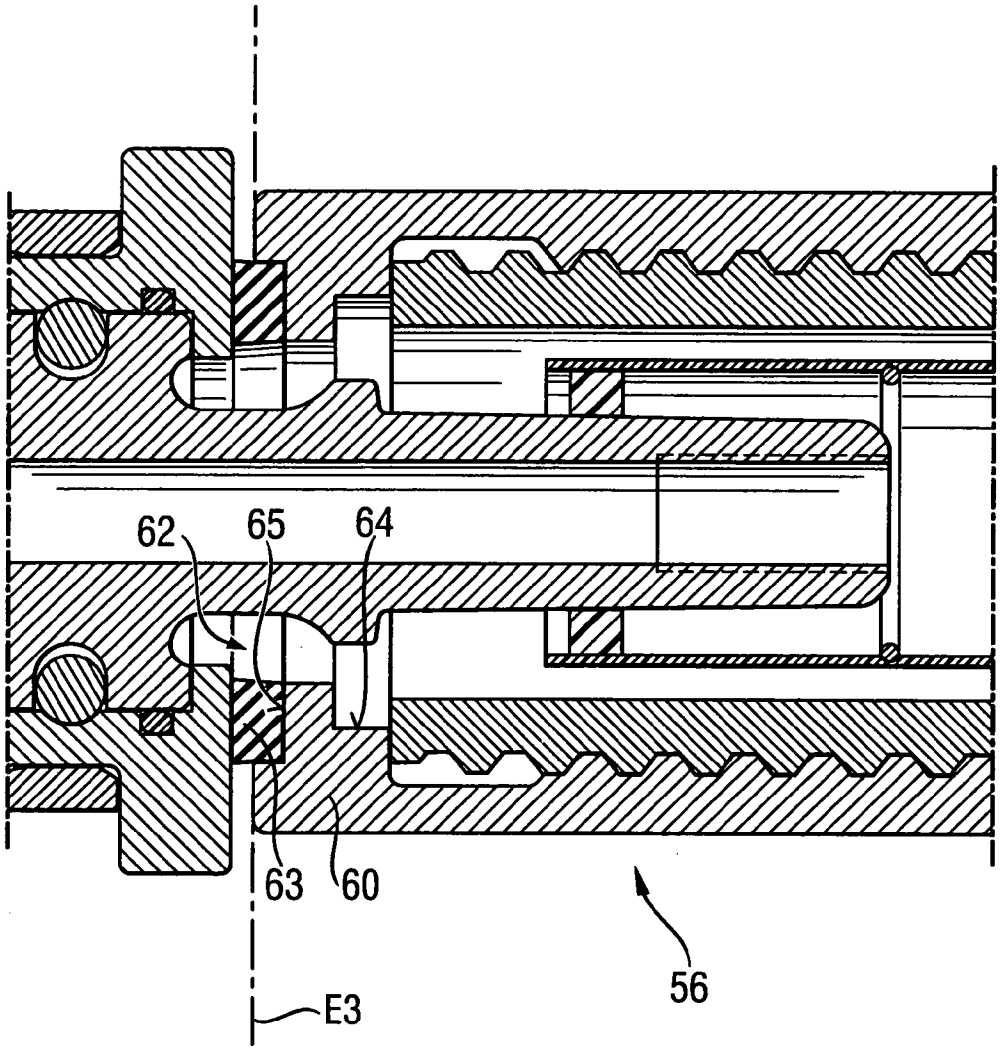
FIG. 4 a detailed cross-sectional view of a third embodiment of the adapter member according to the present invention.

In the embodiment shown in FIG. 4, the adapter member 56 has, in the bottom 60 which is provided with a rim 64 that limits the through-opening 62 formed in the bottom 60, a circumferential recess 65 in which a ring-shaped seal 63 is secured with glue. The seal 63 extends past plane E3 defined by an end surface of a bottom 60.

Figure 5:
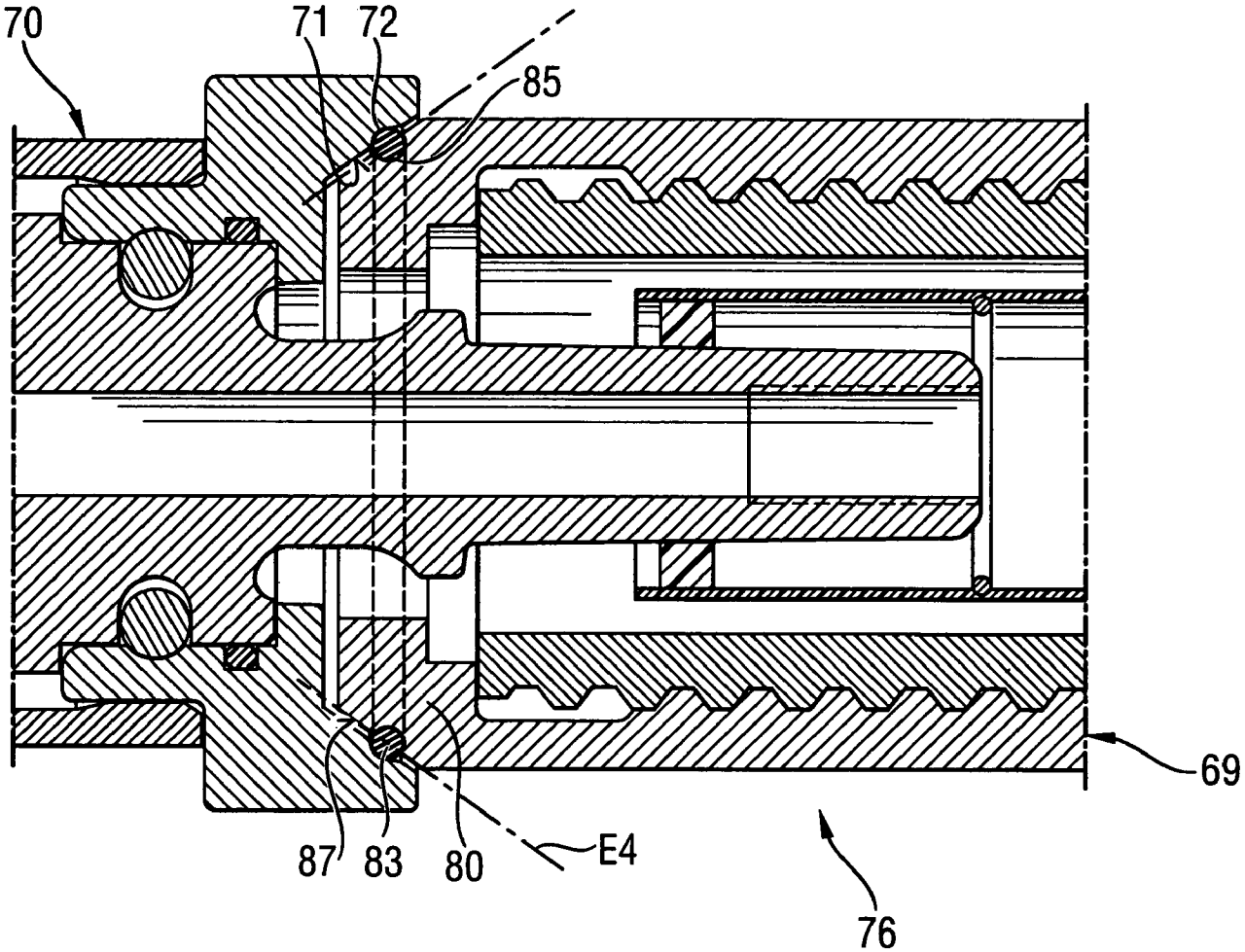
FIG. 5 a detailed cross-sectional view of a fourth embodiment of the adapter member according to the present invention.

An adapter 76, which is shown in FIG. 5, has a bottom 80 with a circumferential chamfered rim 87. On the rim 87, there is provided a circumferential recess 85 in which a seal 83, which is formed as an O-ring of an elastomer, is located. The seal 83 extends past plane E4 defined by the chamfered rim 87 of the bottom 80. In a bearing surface 71 of the tool 70, there is provided a recess 72, in which the seal 83 is located in the connected condition of the tool 70 with the rock anchor 69.

Though the present invention was shown and described with references to the preferred embodiments, such is merely illustrative of the present invention and is not to be construed as a limitation thereof and various modifications of the present invention will be apparent to those skilled in the art. It is therefore not intended that the present invention be limited to the disclosed embodiments or details thereof, and the present invention includes all variations and/or alternative embodiments within the spirit and scope of the present invention as defined by the appended claims.

What is claimed is:

1. An adapter member for connecting a self- drilling rock anchor (1; 31; 69) with a chuck (6) of a drilling tool for transmitting a driving torque to the rock anchor, comprising a sleeve-shaped section (17; 37) having a coupling section (18) for connection with the chuck (6), and a bottom (20; 40; 60; 80) provided at an end (19; 39) of the sleeve-shaped section (17; 37) for forming a receiving space (21) for connection with an end (4; 34) of the rock anchor (1; 31; 69) and having a through-opening (22; 42; 62) through which a feeding nose (10) of a feeding device is extendable; and a seal (23; 43; 63; 83) arranged in a region of the bottom of the sleeve-shaped section (20; 40; 60; 80) and extending from the receiving space (21) to at least a plane (El; E2; E3; E4) defined by the bottom (20; 40; 60; 80) for sealing the adapter member against the rock anchor.

2. An adapter member according to claim 1, wherein a rim (24), which limits the through-opening (22), is provided with retaining means (25) for retaining the seal (23).

3. An adapter member according to claim 2, wherein the retaining means (25) is formed on the rim (24).

4. An adapter member according to claim 2, wherein the retaining means (25) circumferentially extends over the rim (24).

5. An adapter member according to claim 1, wherein the seal (43) at least partially surrounds a rim (44) limiting the through-opening (42).

6. An adapter member according to claim 1, wherein the bottom (60; 80) is provided with a recess (65; 85) for at least partially receiving the seal (63; 83).

7. An adapter member according to claim 6, wherein the recess (65; 85) extends circumferentially over the bottom (60; 80).

* * * * *